US006474075B1

(12) United States Patent
Tanaka et al.

(10) Patent No.: US 6,474,075 B1
(45) Date of Patent: Nov. 5, 2002

(54) REGENERATOR FOR A STIRLING CYCLE BASED SYSTEM

(75) Inventors: Syozo Tanaka, Nara (JP); Kenji Takai, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/481,395

(22) Filed: Jan. 12, 2000

(30) Foreign Application Priority Data

Jan. 29, 1999 (JP) ..... 11-021321

(51) Int. Cl.[7] ..... F25B 9/00
(52) U.S. Cl. ..... 62/6
(58) Field of Search ..... 62/6; 165/4, 10

(56) References Cited

U.S. PATENT DOCUMENTS 4,866,943 A * 9/1989 Purcell et al. ..... 62/6
5,429,177 A * 7/1995 Yaron et al. ..... 165/10
5,445,216 A 8/1995 Cannata
5,573,060 A 11/1996 Adderley et al.

FOREIGN PATENT DOCUMENTS

| | | |
|---|---|---|
| BE | 1011595 | 11/1999 |
| DE | 1301352 | 8/1969 |
| FR | 2103583 | 4/1972 |

OTHER PUBLICATIONS

Japanese Laid–Open Patent Application No. S62–190391, laid–open on Aug. 20, 1987.
Patent Abstracts of Japan, vol. 012, No. 028, Jan. 27, 1988.

* cited by examiner

*Primary Examiner*—William Doerrler
*Assistant Examiner*—Malik N. Drake

(57) ABSTRACT

In a regenerator for use in a Stirling cycle based system, a plurality of ribs are formed on a surface of a resin film by applying screen printing thereto using photo-curing ink. The resin film is then wound up to produce three separate regenerator cores of identical size. These three regenerator cores are joined together in the direction of the axes thereof. The ribs on the surface of the resin film are formed at regular intervals and parallel to the axes of the cores.

2 Claims, 7 Drawing Sheets

REGENERATOR FOR A STIRLING CYCLE BASED SYSTEM

BACKGROUND OF THE INVENTION

1. Field of the Invention

The present invention relates to a regenerator for use in a Stirling refrigerator, i.e. a refrigerator based on the principle of the Stirling cycle, for the purpose of accumulating the heat of working gas.

2. Description of the Prior Art

FIGS. 1 and 2 show a conventional regenerator designed for use in a Stirling cycle based system. This regenerator 1 is produced by forming irregularities on the surface of a resin film 2 by bonding a plurality of extra-fine spacers 4 at regular intervals and parallel to one another, and then winding the resin film 2 up into a cylindrical shape.

FIG. 3 shows an example of a Stirling refrigerator of a free piston type provided with a regenerator 1 as described just above. This Stirling refrigerator has a cylinder 8 filled with working gas such as helium, a piston 5 and a displacer 7 for dividing the space inside the cylinder 8 into a compression space 9 and an expansion space 10, a linear motor 6 for driving the reciprocating movement of the piston 5, plate springs 11 and 12 for supporting the piston 5 and the displacer 7 in such a way as to permit, by resilience, their reciprocating movement, a heat absorber 14 provided at the expansion space 10 so as to absorb heat from the outside, and a heat dissipater 13 provided at the compression space 9 so as to dissipate heat to the outside.

Reference numeral 15 represents a heat exchanger for heat dissipation, and reference numeral 16 represents a heat exchanger for heat absorption. These heat exchangers serve to prompt the exchange of heat between the inside and the outside, and the regenerator 1 is arranged between these exchangers.

In this Stirling refrigerator having the structure described above, when the linear motor 6 is driven, the piston 5 moves upward inside the cylinder 8, compressing the working gas inside the compression space 9. During this time, although the temperature of the working gas rises, the heat is dissipated through the heat-dissipation heat exchanger 15 and then through the heat dissipater 13 to the outside air, and thus the working gas is cooled, achieving isothermal compression. The working gas compressed inside the compression space 9 is, by its own pressure, transferred through the regenerator 1 into the expansion space 10. During this time, the heat of the working gas is accumulated in the resin film 2 constituting the regenerator 1, causing the temperature of the working gas to fall.

A predetermined phase difference is kept between the reciprocating movement of the displacer 7 and that of the piston 5. When the displacer 7 moves downward, the working gas inside the expansion space 10 expands. During this time, although the temperature of the working gas falls, heat is absorbed from the outside air through the heat absorber 14 and then through the heat-absorption heat exchanger 16, and thus the working gas is heated, achieving isothermal expansion. A while later, when the displacer 7 starts moving upward, the working gas inside the expansion space 10 is transferred through the regenerator 1 back to the compression space 9. During this time, the heat that has previously been accumulated in the regenerator 1 is transferred to the working gas, causing the temperature of the working gas to rise. This sequence of events, called the Stirling cycle, is repeated by the reciprocating movement of the piston 5 and the displacer 7, and, as a result, heat is steadily absorbed through the heat absorber 14 and transferred to the working gas, gradually cooling the absorber 14.

In this way, in the Stirling refrigerator, by transferring the working gas back and forth between the compression space 9 and the expansion space 10 through the regenerator 1, heat is absorbed from the outside air so as to achieve the cooling of the absorber 14. Meanwhile, the regenerator 1 accumulates heat from the working gas in its compressed, and thus hot, state, and transfers the heat back to the working gas in its expanded, and thus cold, state. Here, the larger the amount of heat so accumulated, the higher the heat exchange efficiency, and thus the higher the cooling performance of the Stirling refrigerator.

However, the above-described conventional regenerator 1 for use in a Stirling cycle based system is very expensive because it requires undue time and labor for its production, which involves the bonding, one by one, of the spacers 4 on the surface of the resin film 2. Moreover, as shown in FIG. 4, the working gas passing through the gaps between different turns of the resin film 2, as it passes from the edge of the regenerator 1 inward, tends to move away from the surfaces of the resin film 2 and concentrate roughly at the center of the gaps, because boundary layers develop (in the figure, arrows 20 indicate the flow of the working gas). This lowers the heat transfer rate between the working gas and the resin film 2.

SUMMARY OF THE INVENTION

An object of the present invention is to provide an inexpensive regenerator for use in a Stirling cycle based system by simplifying the production process thereof.

Another object of the present invention is to achieve satisfactorily high heat accumulation performance.

To achieve the above objects, according to one aspect of the present invention, a regenerator for use in a Stirling cycle based system, such as is arranged between a compression space and an expansion space of the Stirling cycle based system so as to serve as a flow passage for working gas transferred back and forth between the compression space and the expansion space and simultaneously serve to accumulate the heat of the working gas, is produced by forming a plurality of ribs integrally on a surface of a resin film and winding the resin film up into a cylindrical shape.

According to another aspect of the present invention, a regenerator for use in a Stirling cycle based system, such as is arranged between a compression space and an expansion space of the Stirling cycle based system so as to serve as a flow for working gas transferred back and forth between the compression space and the expansion space and simultaneously serve to accumulate the heat of the working gas, is produced by joining together two or more cores in the direction of the axes of the cores. Here, the cores are each produced by forming a plurality of ribs integrally on a surface of a resin film and winding the resin film up into a cylindrical shape.

According to still another aspect of the present invention, a regenerator for use in a Stirling cycle based system, such as is arranged between a compression space and an expansion space of the Stirling cycle based system so as to serve as a flow passage for working gas transferred back and forth between the compression space and the expansion space and simultaneously serve to accumulate the heat of the working gas, is produced by forming a plurality of ribs integrally on both surfaces of a resin film and winding the resin film up into a cylindrical shape. Here, the ribs are inclined relative to the axis of the regenerator.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Hereinafter, embodiments of the present invention will be described in more detail with reference to the accompanying drawings.

<First Embodiment>

Figure 5:
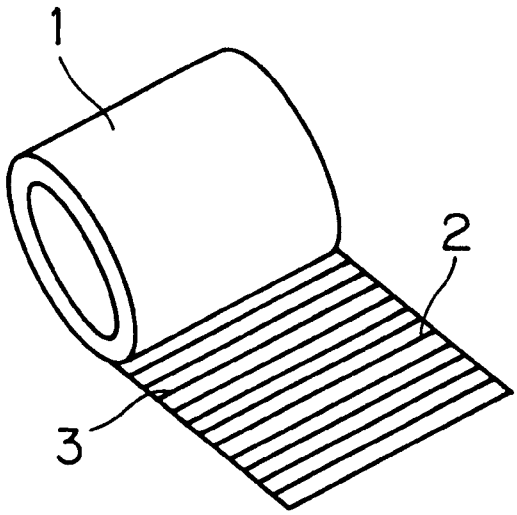
FIG. 5 is a perspective view of the regenerator, for use in a Stirling cycle based system, of a first embodiment of the invention.
Figure 6:
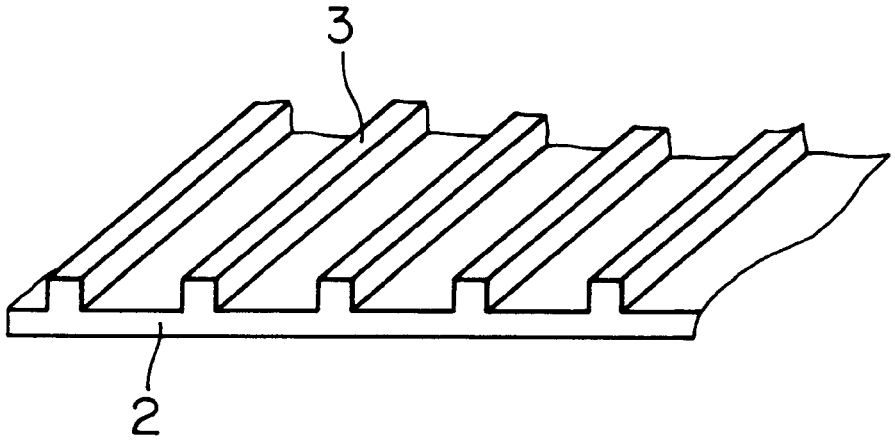
FIG. 6 is an enlarged view of a principal portion of the regenerator of the first embodiment.

A first embodiment of the invention will be described below with reference to FIGS. 5 and 6. FIG. 5 is a perspective view of the regenerator, for use in a Stirling cycle based system, of the first embodiment, and FIG. 6 is an enlarged view of a principal portion thereof. This regenerator 1 is produced by winding up a resin film 2 into a cylindrical shape. On the surface of the resin film 2, a plurality of ribs 3 are formed integrally with the resin film 2 at regular intervals and parallel to the axis of the regenerator 1.

The resin film 2 is preferably made of a material having high specific heat, low heat conductivity, high heat resistance, low moisture absorbency, and other desirable properties, for example polyethylene terephthalate (PET), a polyimide, or the like. The ribs 3 are preferably formed, for example, by applying photo-curing ink to the surface of the resin film 2 and then applying screen printing thereto, or by pressing a heated metal mold against the surface of the resin film 2 (a thermoforming process).

The regenerator 1 of this embodiment employs a resin film 2 having ribs 3 formed integrally on the surface thereof, and thus can be produced at lower cost and with more ease than a conventional regenerator that requires the bonding of spacers.

<Second Embodiment>

Figure 7:
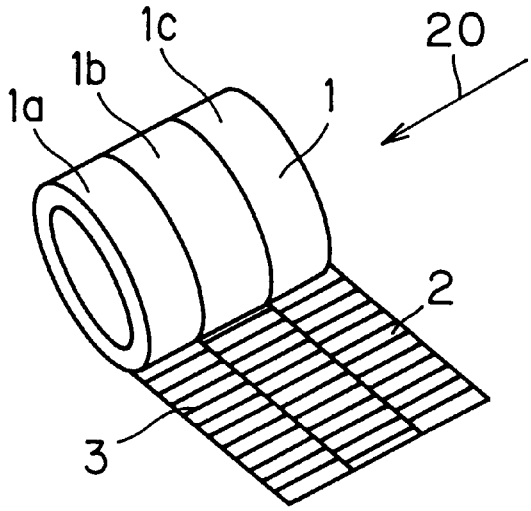
FIG. 7 is a perspective view of the regenerator, for use in a Stirling cycle based system, of a second embodiment of the invention.

A second embodiment of the invention will be described below with reference to FIG. 7. FIG. 7 is a perspective view of the regenerator, for use in a Stirling cycle based system, of the second embodiment. This regenerator 1 is produced by joining together three cylinder-shaped regenerator cores 1*a,* 1*b,* and 1*c* of identical size in the direction of the axes thereof. The regenerator cores 1*a,* 1*b,* and 1*c* are each produced by forming a plurality of ribs 3 integrally on the surface of a resin film 2 at regular intervals and parallel to the axis of the core and then winding up the resin film 2 into a cylindrical shape. The ribs 3 are formed at the same intervals in all of the regenerator cores 1*a,* 1*b,* and 1*c*.

The regenerator 1 of this embodiment is produced by joining together shorter regenerator cores 1*a,* 1*b* , and 1*c* , and therefore some of the ribs 3 are left discontinuous between adjacent cores. As a result, when the working gas, flowing from the direction indicated by an arrow 20 and then passing between the ribs 3 of the regenerator core 1*c,* flows into the regenerator core 1*b,* it collides with the ribs 3 of the regenerator core 1*b* and thereby its flow is disturbed. Thus, boundary layers are cut off before developing. The same occurs when the working gas passes from the regenerator core 1*b* to the regenerator core 1*a*.

In this way, the development of boundary layers at the seams between the regenerator cores 1*a,* 1*b,* and 1*c* is prevented, and this helps reduce the lowering of the heat transfer rate between the working gas and the resin film 2. Thus, the regenerator 1 of this embodiment offers much higher heat accumulation performance than a conventional regenerator or the regenerator of the first embodiment where the regenerator 1 is composed of a single core. Moreover, since the ribs 3 are formed at regular intervals and parallel to each other, the resin film 2 can be mass-produced with minimal variations in performance among the regenerator cores 1*a,* 1*b,* and 1*c*.

It is to be understood that, although this embodiment deals with a case where the regenerator 1 is composed of three regenerator cores 1*a,* 1*b,* and 1*c,* it is also possible to use more regenerator cores in expectation of still higher heat accumulation performance.

<Third Embodiment>

Figure 3:
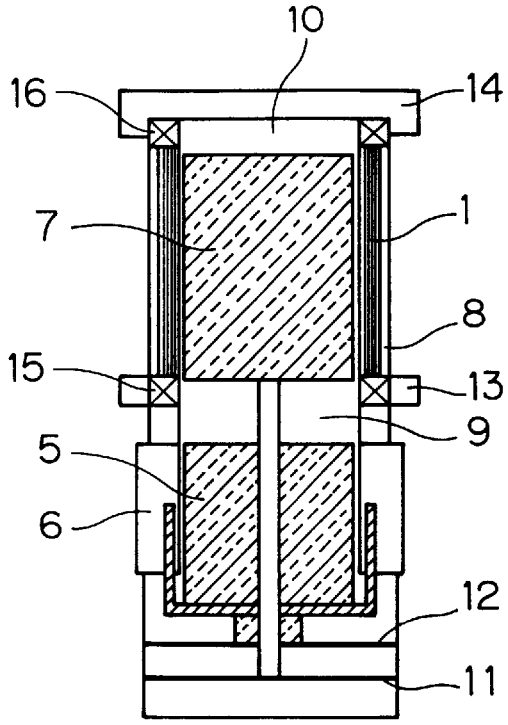
Fig.3 PRIOR ART
FIG. 3 is a sectional view of a typical Stirling refrigerator as seen from the side.
Figure 4:
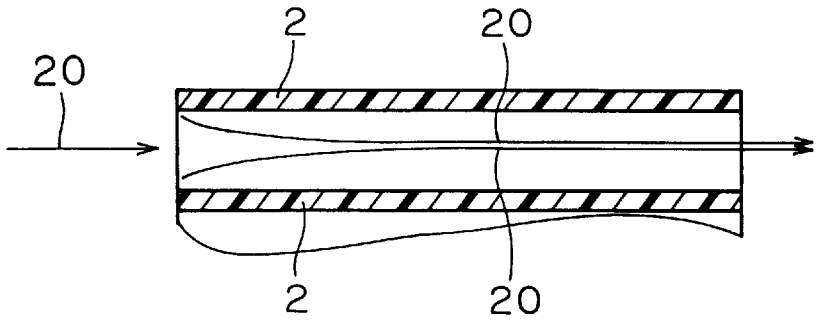
Fig.4 PRIOR ART
FIG. 4 is a diagram illustrating the flow of the working gas passing through the inside of the conventional regenerator.
Figure 8:
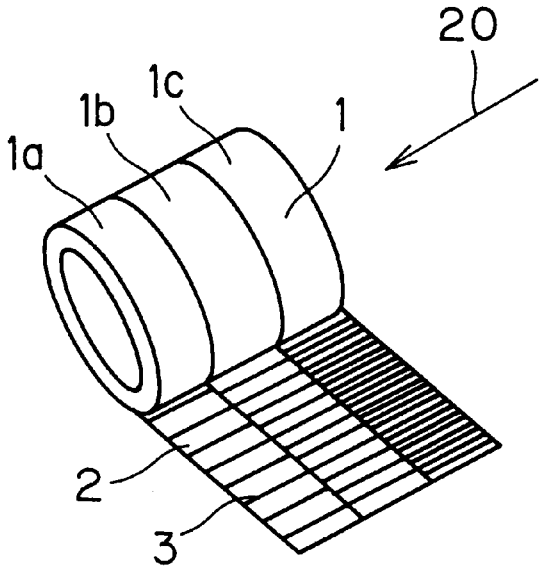
FIG. 8 is a perspective view of the regenerator, for use in a Stirling cycle based system, of a third embodiment of the invention.

A third embodiment of the invention will be described below with reference to FIG. 8. FIG. 8 is a perspective view of the regenerator, for use in a Stirling cycle based system, of the third embodiment. This regenerator 1 is produced, as in the second embodiment, by joining together three cylinder-shaped regenerator cores 1*a,* 1*b,* and 1*c* of identical size in the direction of the axes thereof. Here, the regenerator 1, at its end on the regenerator core 1*a* side, communicates with the expansion space 10 (see FIG. 3), and, at its end on the regenerator core 1*c* side, communicates with the compression space 9 (see FIG. 3).

In each of the regenerator cores 1*a,* 1*b,* and 1*c,* a plurality of ribs 3 are formed integrally at regular intervals and parallel to the axis thereof. These ribs 3 are formed at intervals that increase stepwise toward the expansion space 10; that is, they are formed at longer intervals in the regenerator core 1*b* than in the regenerator core 1*c,* and at longer intervals in the regenerator core 1*a* than in the regenerator core 1*b*.

While the working gas, flowing from the compression space 9 (i.e. from the direction indicated by an arrow 20), is passing through the inside of the regenerator 1, its heat is absorbed by the heat accumulation effect of the regenerator 1, and thus, as the working gas approaches the expansion space 10, its temperature gradually falls. According as the working gas becomes colder, its density becomes higher, and thus its flowability becomes lower. Therefore, according as the working gas approaches the expansion space 10, its flow becomes less smooth. This is the reason that, in this embodiment, the ribs 3 are formed at intervals that increase toward the expansion space 10. This helps make almost uniform the flow resistance against the working gas throughout the regenerator 1 and thereby achieve optimal flowability and uniform flow-rate distribution of the working gas. Thus, the regenerator 1 of this embodiment, where also the development of boundary layers is prevented by the joining together of the regenerator cores 1*a,* 1*b,* and 1*c,* offers even higher heat accumulation performance.

<Fourth Embodiment>

Figure 9:
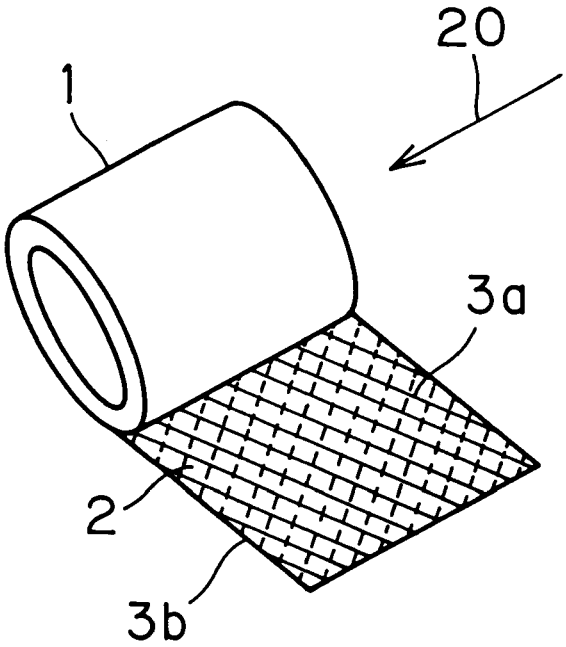
FIG. 9 is a perspective view of the regenerator, for use in a Stirling cycle based system, of a fourth embodiment of the invention.
Figure 10:
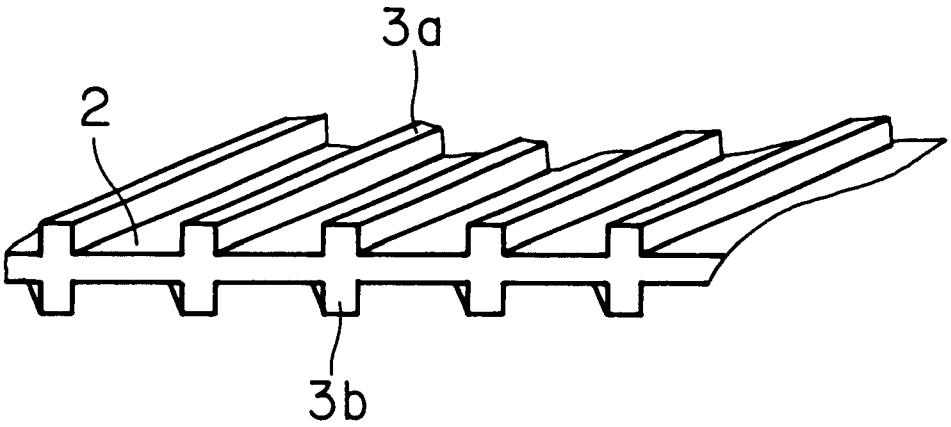
FIG. 10 is an enlarged view of a principal portion of the regenerator of the fourth embodiment.

A fourth embodiment of the invention will be described below with reference to FIGS. 9 and 10. FIG. 9 is a perspective view of the regenerator, for use in a Stirling cycle based system, of the fourth embodiment, and FIG. 10 is an enlarged view of a principal portion thereof. This regenerator 1 is produced by winding up a resin film 2 into a cylindrical shape. On both the top and bottom surfaces of the resin film 2, a plurality of top-side ribs (indicated by solid lines 3*a* in FIG. 9) and a plurality of back-side ribs (indicated by dotted lines 3*b* in FIG. 9), respectively, are formed integrally at regular intervals and parallel to one another. The top-side ribs 3*a* and the back-side ribs 3*b* are inclined in opposite directions relative to the axis of the regenerator 1. Thus, when the resin film 2 is wound up, overlapping turns thereof make contact with one another at the intersections between the top-side ribs 3*a* of one turn and the back-side ribs 3*b* of another, and this helps secure gaps that serve as flow passages for the working gas.

Figure 11:
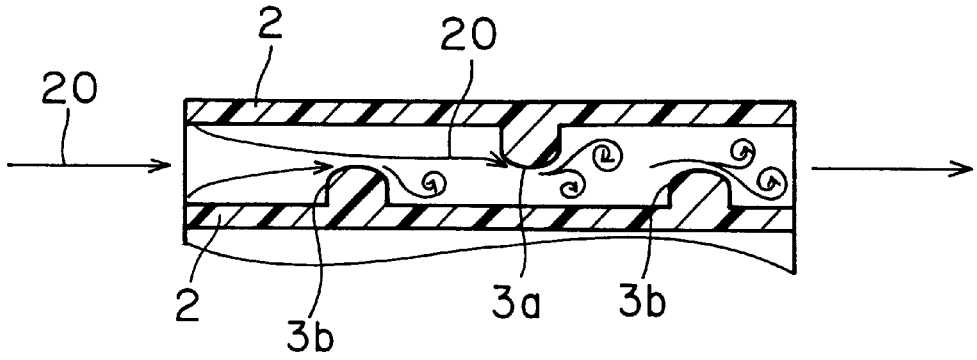
FIG. 11 is a diagram illustrating the flow of the working gas passing through the inside of the regenerator of the fourth embodiment.

As shown in FIG. 11, when the working gas, flowing from the direction indicated by an arrow 20, passes through the gaps between different turns of the resin film 2, it collides with the top-side ribs 3*a* and the back-side ribs 3*b* protruding from below and from above, and thereby its flow is disturbed, causing eddies to appear. As a result, the boundary layers that have been developing from the edge of the regenerator 1 are cut off by the top-side ribs 3*a* and the back-side ribs 3*b*. This helps improve the heat transfer rate between the working gas and the resin film 2. Thus, the regenerator 1 of this embodiment, where the top-side ribs 3*a* and the back-side ribs 3*b* also serve to secure a wider heat transfer surface area, offers far higher heat accumulating performance.

Moreover, the top-side ribs 3*a,* and also the back-side ribs 3*b* , are formed at regular intervals and parallel to one another, and therefore the intersections at which the top-side ribs 3*a* and the back-side ribs 3*b* make contact with each other are distributed evenly over the entire resin film 2. Thus, the regenerator 1 of this embodiment offers stable heat accumulation performance with almost no variations.

Next, the result of performance evaluation conducted with an actually produced sample of the regenerator 1 for use in a Stirling cycle based system of the fourth embodiment described above will be presented. The table below lists the specifications of the ribbed resin film employed in this regenerator.

| | | |
|---|---|---|
| Film | Material | Polyethylene terephthalate |
| | Thickness | 70 (μm) |
| Ribs | Material | UV ink |
| | Formation process | Screen printing |
| | Width | 100 (μm) |
| | Height | 35 (μm) |
| | Pitch | 2 (mm) |
| | Angle relative to winding direction | 15 (deg.) |

Figure 1:
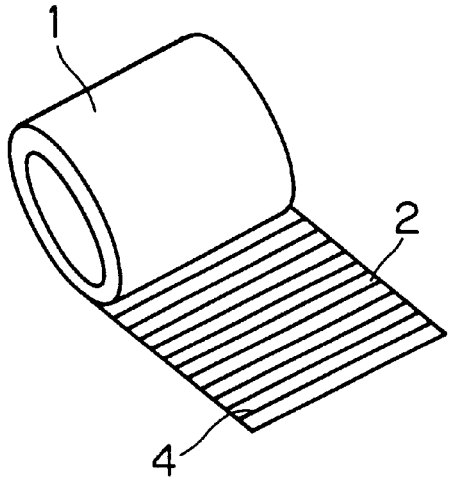
Fig.1 PRIOR ART
FIG. 1 is a perspective view of a conventional regenerator for use in a Stirling cycle based system.
Figure 2:
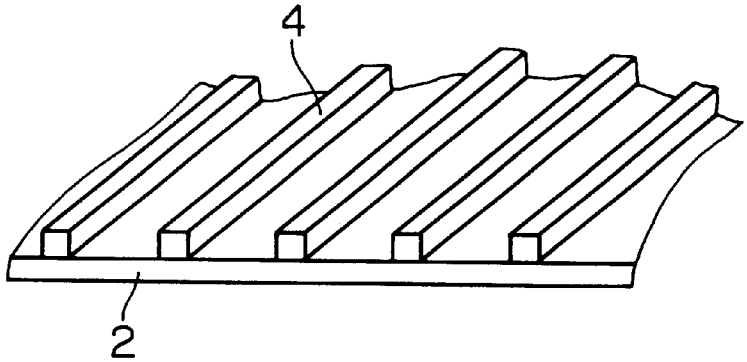
Fig.2 PRIOR ART
FIG. 2 is an enlarged view of a principal portion of the conventional regenerator.

A resin film having the above-listed specifications was wound up into a cylindrical shape to produce a regenerator for use in a Stirling cycle based system. This regenerator was fitted inside the cylinder of a Stirling refrigerator, and the working gas was transferred back and forth between the compression space and the expansion space at varying reciprocating flow rates G (L/m) to determine the regenerator efficiency η. In addition, for comparison, the same performance evaluation was conducted also with a conventional regenerator (see FIG. 1) produced using a resin film having spacers bonded on the surface thereof.

The regenerator efficiency η mentioned above serves as an index for evaluating the heat accumulation performance of a regenerator designed for use in a Stirling cycle based system, and is given by the following formula:

$$\eta = (Th_{in} - Th_{out})/(Th_{in} - Tc_{in}) \quad (1)$$

$$= (Tc_{out} - Tc_{in})/(Th_{in} - Tc_{in})$$

where $Th_{in}$ represents the temperature of the working gas immediately before the working gas compressed in the compression space flows into the regenerator;

$Th_{out}$ represents the temperature of the working gas immediately after the working gas flows out of the regenerator into the expansion space;

$Tc_{in}$ represents the temperature of the working gas immediately before the working gas flows out of the expansion space into the regenerator; and $Tc_{out}$ represents the temperature of the working gas immediately after the working gas flows out of the regenerator into the compressed space.

In a Stirling cycle based system, the following relations hold:

$$Th_{in} > Th_{out}$$

$$Tc_{out} > Tc_{in}$$

$$Th_{in} > Tc_{out}$$

Accordingly, in the formula (1) above, the denominator is never less than the numerator. Hence, the regenerator efficiency η takes a value within the following range:

$$0 < \eta 1 \leqq 1$$

The greater (closer to 1) the regenerator efficiency η, the higher the heat transfer efficiency with which the regenerator exchanges heat with the working gas, and thus the smaller the loss of heat, achieving a nearly ideal Stirling cycle.

Figure 12:
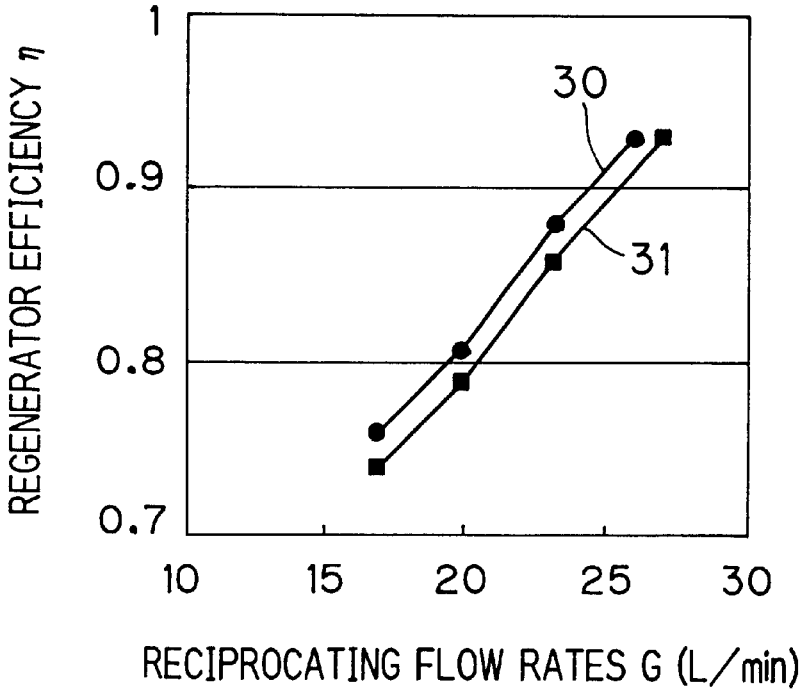
FIG. 12 is a diagram showing the result of performance evaluation of the regenerator of the fourth embodiment.

FIG. 12 shows the result of the performance evaluation described above. In this figure, reference numeral 30 indicates a graph of the regenerator efficiency of a regenerator that adopts a structure according to the present invention, and reference numeral 31 indicates a graph of the regenerator efficiency of a regenerator that adopts a conventional structure. As shown in this figure, even if the reciprocating flow rate varies, the regenerator that adopts a structure according to the present invention offers higher regenerator efficiency and thus higher heat accumulation performance than the regenerator that adopts a conventional structure.

<Fifth Embodiment>

Figure 13:
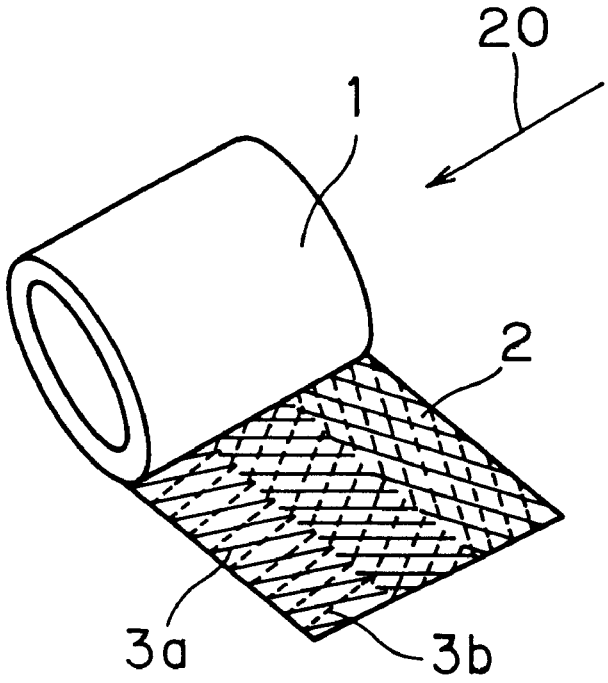
FIG. 13 a perspective view of the regenerator, for use in a Stirling cycle based system, of a fifth embodiment of the invention.

A fifth embodiment of the invention will be described below with reference to FIG. 13. FIG. 13 is a perspective view of the regenerator, for use in a Stirling cycle based system, of the fifth embodiment. This regenerator 1 is produced by winding up a resin film 2 into a cylindrical shape. With respect to the direction of the flow of the working gas indicated by an arrow 20, the regenerator 1, at its upstream-side end, communicates with the compression space 9 (see FIG. 3) and, at its downstream-side end, communicates with the expansion space 10 (see FIG. 3).

On both the top and bottom surfaces of the resin film 2, a plurality of top-side ribs 3*a* and a plurality of back-side ribs 3*b*, respectively, are formed integrally at regular intervals and parallel to one another. The top-side ribs 3*a* and the back-side ribs 3*b* are inclined in opposite directions relative to the axis of the regenerator 1. Moreover, the top-side ribs 3*a* and the back-side ribs 3*b* are formed, relative to the axis, at inclination angles that decrease stepwise toward the end at which the regenerator 1 communicates with the expansion space 10.

As described previously, according as the working gas approaches the expansion space 10, its temperature falls, and its density becomes higher. By forming the top-side ribs 3*a* and the back-side ribs 3*b* at inclination angles that decrease stepwise in accordance with the increase in the density of the working gas, it is possible to reduce the flow resistance against the working gas in a portion of the regenerator 1 near the expansion space 10, and thereby readily achieve optimal flowability and uniform flow-rate distribution of the working gas.

It is to be understood that, although this embodiment deals with a case where the inclination angles of the ribs are changed in three steps, it is also possible to change them in more steps to gain the above-noted advantages to a greater extent.

What is claimed is:

1. A regenerator for use in a Stirling cycle based system, the regenerator being arranged between a compression space and an expansion space of the Stirling cycle based system so as to serve as a flow passage for working gas transferred back and forth between the compression space and the expansion space and simultaneously serve to accumulate heat of the working gas, the regenerator is produced by forming a plurality of ribs integrally on a surface of a resin film and winding the resin film up into a cylindrical shape, wherein the ribs are formed by applying photo-curing ink to the surface of the resin film and then applying screen printing thereto.

2. A regenerator for use in a Stirling cycle based system, the regenerator being arranged between a compression space and an expansion space of the Stirling cycle based system so as to serve as a flow passage for working gas transferred back and forth between the compression space and the expansion space and simultaneously serve to accumulate heat of the working gas, the regenerator is produced by forming a plurality of ribs integrally on a surface of a resin film and winding the resin film up into a cylindrical shape, wherein the ribs are formed by pressing a heated metal mold against the surface of the resin film.

* * * * *